US011891891B2

(12) United States Patent
Archibald

(10) Patent No.: US 11,891,891 B2
(45) Date of Patent: Feb. 6, 2024

(54) SWITCH DEVICE WITH NON-ADDRESSABLE SCHEME FOR WELLBORE OPERATIONS

(71) Applicant: GEODYNAMICS, INC., Millsap, TX (US)

(72) Inventor: Roger Archibald, Hurst, TX (US)

(73) Assignee: GEODYNAMICS, INC., Millsap, TX (US)

( * ) Notice: Subject to any disclaimer, the term of this patent is extended or adjusted under 35 U.S.C. 154(b) by 444 days.

(21) Appl. No.: 17/443,701

(22) Filed: Jul. 27, 2021

(65) Prior Publication Data

US 2022/0034221 A1 Feb. 3, 2022

Related U.S. Application Data

(60) Provisional application No. 63/057,664, filed on Jul. 28, 2020.

(51) Int. Cl.
*E21B 47/13* (2012.01)
*E21B 43/1185* (2006.01)

(52) U.S. Cl.
CPC ..... *E21B 47/13* (2020.05); *E21B 43/11857* (2013.01)

(58) Field of Classification Search
CPC . E21B 47/13; E21B 43/11857; E21B 43/1185
See application file for complete search history.

(56) References Cited

U.S. PATENT DOCUMENTS 4,208,966 A * 6/1980 Hart ..... F42D 1/055 340/856.4
9,880,146 B2 * 1/2018 Troxler ..... G01N 33/24
10,309,812 B1 * 6/2019 Zhang ..... G01F 1/86
10,809,175 B1 * 10/2020 Ayadat ..... G01N 15/0826
2014/0151018 A1 * 6/2014 Lerche ..... E21B 43/11857 102/202.5
2016/0216404 A1 * 7/2016 Kristensen ..... E21B 49/10
2017/0212269 A1 * 7/2017 Itskovich ..... G01V 3/26
2017/0314390 A1 * 11/2017 Thompson ..... H01P 3/082
2018/0266233 A1 * 9/2018 Ahmed ..... E21B 47/047
2018/0349508 A1 * 12/2018 Bequet ..... G06F 18/217
(Continued)

FOREIGN PATENT DOCUMENTS

WO 2019245800 A1 12/2019

*Primary Examiner* — Amine Benlagsir
(74) *Attorney, Agent, or Firm* — Morgan, Lewis & Bockius LLP

(57) ABSTRACT

A non-addressable switch device that is part of a chain of switch devices in a gun string, the non-addressable switch device including a first switch configured to make an electrical connection between an electrical line and another non-addressable switch device of the chain of switch devices; a second switch configured to make an electrical connection between a detonator and the electrical line; and a processor $P_A$ connected to the first and second switches and configured to close and open the first and second switches. The processor $P_A$ is configured to not use a digital address, and the processor $P_A$ is configured to perform one of plural functions based on a corresponding pulse received along the electrical line.

11 Claims, 6 Drawing Sheets

(56) References Cited

U.S. PATENT DOCUMENTS

| | | | | |
|---|---|---|---|---|
| 2018/0371894 | A1* | 12/2018 | Wang | E21B 41/00 |
| 2019/0195063 | A1* | 6/2019 | Weston | E21B 47/022 |
| 2019/0390547 | A1* | 12/2019 | Pietrzyk | G05B 15/02 |

* cited by examiner

SWITCH DEVICE WITH NON-ADDRESSABLE SCHEME FOR WELLBORE OPERATIONS

BACKGROUND

Technical Field

Embodiments of the subject matter disclosed herein generally relate to downhole tools for oil and gas operations, and more specifically, to a gun string having one or more switch devices that are capable of collecting diagnostic information from associated downhole equipment and of reducing a communication time with a surface controller without using a digital address.

Discussion of the Background

After a well 100 is drilled to a desired depth H relative to the surface 102, as illustrated in FIG. 1, and the casing 110 protecting the wellbore 104 has been installed and cemented in place, it is time to connect the wellbore 104 to the subterranean formation 106 to extract the oil and/or gas.

The process of connecting the wellbore to the subterranean formation may include the following steps: (1) placing a plug 112 with a through port 114 (known as a frac plug) above a just stimulated stage 116, (2) closing the plug, and (3) perforating a new stage 118 above the plug 112. The step of perforating is achieved with a gun string 120 that is lowered into the well with a wireline 122. A surface controller 124 located at the surface 102 controls the wireline 122 and also sends various commands along the wireline to actuate the perforating guns of the gun string.

A traditional gun string 120 includes plural perforating guns 126 connected to each other by corresponding subs 128, as illustrated in FIG. 1. Each sub 128 may include a detonator 130 and a corresponding switch 132. The detonator 130 is not connected to the through line (a wire that extends from the surface controller to the last perforating gun and transmits the actuation command to the corresponding switches of the perforating guns) until the corresponding switch 132 is actuated. The corresponding switch 132 is armed by the detonation of a downstream gun. When this happens, the detonator 130 becomes connected to the through line, and when a command from the surface actuates the switch 132, the corresponding detonator 130 of the perforating gun is actuated.

For a conventional perforating gun string 120, the perforating guns 126 are first loaded with charges and a corresponding detonator cord. The perforating guns are then connected to each other through corresponding subs 128. Each of these subs contains the switch 132 with pressure bulkhead capabilities. Once the sub is assembled to the perforating gun, the wires and detonation cord are pulled through a port into the sub, allowing for the installation of the detonator, the corresponding switch, and the connection of the wirings. Those skilled in the field know that this assembly operation has its own risks, i.e., miswiring, which may render one or more of the switches and corresponding detonators unusable.

After the conventional perforating guns have been connected to each other to form the gun string, none of the detonators are electrically connected to the through wire or through line running through the gun string. This is because each perforating gun has a pressure-actuated single pole double throw (SPDT) switch. The normally closed contact on these switches connects the through wire from perforating gun to perforating gun. Once the switch has been activated by the blast of the perforating gun beneath (when that guns goes off), the switch changes its state, connecting the through wire coming from above to one lead of the detonator. The other lead of the detonator is wired to ground the entire time.

In this configuration, after assembly, it is not possible to select which switch of the plurality of switches is to be activated. Once a fire command is sent from the surface controller 124, the most distal switch is activated. The blast from the corresponding perforating gun then activates the next switch and so on. However, new technologies are making use of an addressable switch, i.e., a switch that has a processor with a unique digital address (which makes the switch "addressable," i.e., a command from the surface controller can be send only to a desired switch in the chain) and the surface controller 124 is configured to send targeted commands to the desired addressable switch, based on the unique digital address of each switch.

However, one of the limiting factors of the traditional addressable switches is the time it takes them to communicate with the surface controller. In this regard, each addressable switch in the string will be woken up by the surface controller, one at a time, working in series down the gun string. As each addressable switch wakes up, it will send a data packet to surface, which includes the switch's unique digital address, as well as some status information. The surface controller references this unique digital address when sending commands to control this addressable switch. A significant amount of the data packets exchanged between the addressable switches and the surface controller and between the surface controller and the addressable switches represents the switch's address itself. The time required to send these data packets between uphole and downhole electronics limits how fast the gun string can be pulled out of the hole while shooting on the fly.

The unique digital address of the addressable switch serves a couple of purposes, but largely it gives a unique identifier to each switch in the string. This is important because if a switch shorts out (for example due to enabling its bypass line into a short circuit below the switch), then it is common for the switch to briefly turn off due to the short. The turning off of the addressable switch means that the feedthrough circuit turns off, removing the short and causing the addressable switch to turn back on. When the addressable switch turns back on, it will report its presence to the surface controller, by sending its digital address. The switch's unique digital address will let the surface system determine if this is a new switch (previously un-registered address) or if this is a switch that was already previously registered, but has just been turned on/off due to a short circuit on the feedthrough line.

All these steps increase the amount of data packets that are exchanged between the various addressable switches and the surface controller. Currently, with most addressable switch technologies, the solution is to slow down well operations when operating a long gun string in order to allow time to communicate with all the addressable switches. Slowing down or stopping the winch during plug-and-perf operations increases the chances of becoming stuck, which is undesired. An alternative method uses a Hybrid/Rapid Fire switch (GEODynamics, USA) which removes the requirement for communications from the surface controller to the switches. With this configuration, there is no need for a unique address because the switches each sense their feedthrough status and if a short is detected, they are configured to not turn on their feedthrough. The disadvantage of this system is that it reduces the amount of diagnostic information available on surface as the switches do not communicate with the surface controller and significantly reduces how much control the user has over the switch string.

Thus, there is a need to provide a downhole system that overcomes the above noted problems and offers the operator of the well the capability to collect diagnostic data related to the gun string while not overburdening the communication with the unique addresses of the switches.

SUMMARY

According to an embodiment, there is a non-addressable switch device that is part of a chain of switch devices in a gun string. The non-addressable switch device includes a first switch configured to make an electrical connection between an electrical line and another non-addressable switch device of the chain of switch devices, a second switch configured to make an electrical connection between a detonator and the electrical line, and a processor $P_A$ connected to the first and second switches and configured to close and open the first and second switches. The processor $P_A$ is configured to not use a digital address, and the processor $P_A$ is configured to perform one of plural functions based on a corresponding pulse received along the electrical line.

According to another embodiment, there is a non-addressable switch device that is part of a chain of switch devices in a gun string. The non-addressable switch device includes a first switch configured to make an electrical connection between an electrical line and another non-addressable switch device of the chain of switch devices, a second switch configured to make an electrical connection between a detonator and the electrical line, a processor $P_A$ connected to the first and second switches and configured to close and open the first and second switches, and a tank circuit configured to store a voltage having a predetermined value. The processor $P_A$ is configured to measure the predetermined value and determine, based on the measurement, whether the switch device is freshly powered up or the switch device recovered from a short circuit.

According to yet another embodiment, there is a chain of non-addressable switch devices that includes plural non-addressable switch devices electrically connected to each other through an electrical line, and plural downhole tools, each hosting a corresponding non-addressable switch device. Each non-addressable switch device includes a first switch configured to make an electrical connection between the electrical line and another non-addressable switch device of the chain of switch devices, a second switch configured to make an electrical connection between a corresponding detonator and the electrical line, and a processor $P_A$ connected to the first and second switches and configured to close and open the first and second switches. The processor $P_A$ is configured to not use a digital address, and the processor $P_A$ is configured to perform one of plural functions based on a corresponding pulse received along the electrical line.

According to another embodiment, there is a method for controlling a chain of non-addressable switch devices associated with a gun string. The method includes powering up the chain, sending down a first pulse, from a surface controller to a first non-addressable switch device of the chain, wherein the first pulse is associated with a first function to be performed by the first non-addressable switch device, performing the first function, sending up, from the first non-addressable switch device of the chain to the surface controller, a result of the executed function, sending down a second pulse from the surface controller, to close a first switch of the first non-addressable switch device of the chain to achieve electrical contact with a second non-addressable switch device of the chain, automatically entering the first non-addressable switch device of the chain in a sleep mode, and sending down one of the first or second pulses, from the surface controller, to the second non-addressable switch device of the chain. Only one non-addressable switch device of the chain is available for communication with the surface controller.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a non-addressable switch system that communicates faster than an addressable switch system, and also is capable of collecting various data about the associated detonator and/or other parameters of the gun string. The embodiments discussed herein are applicable not only to gun strings located in wellbore, but to other systems that have various elements connected in a string mode.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 2:
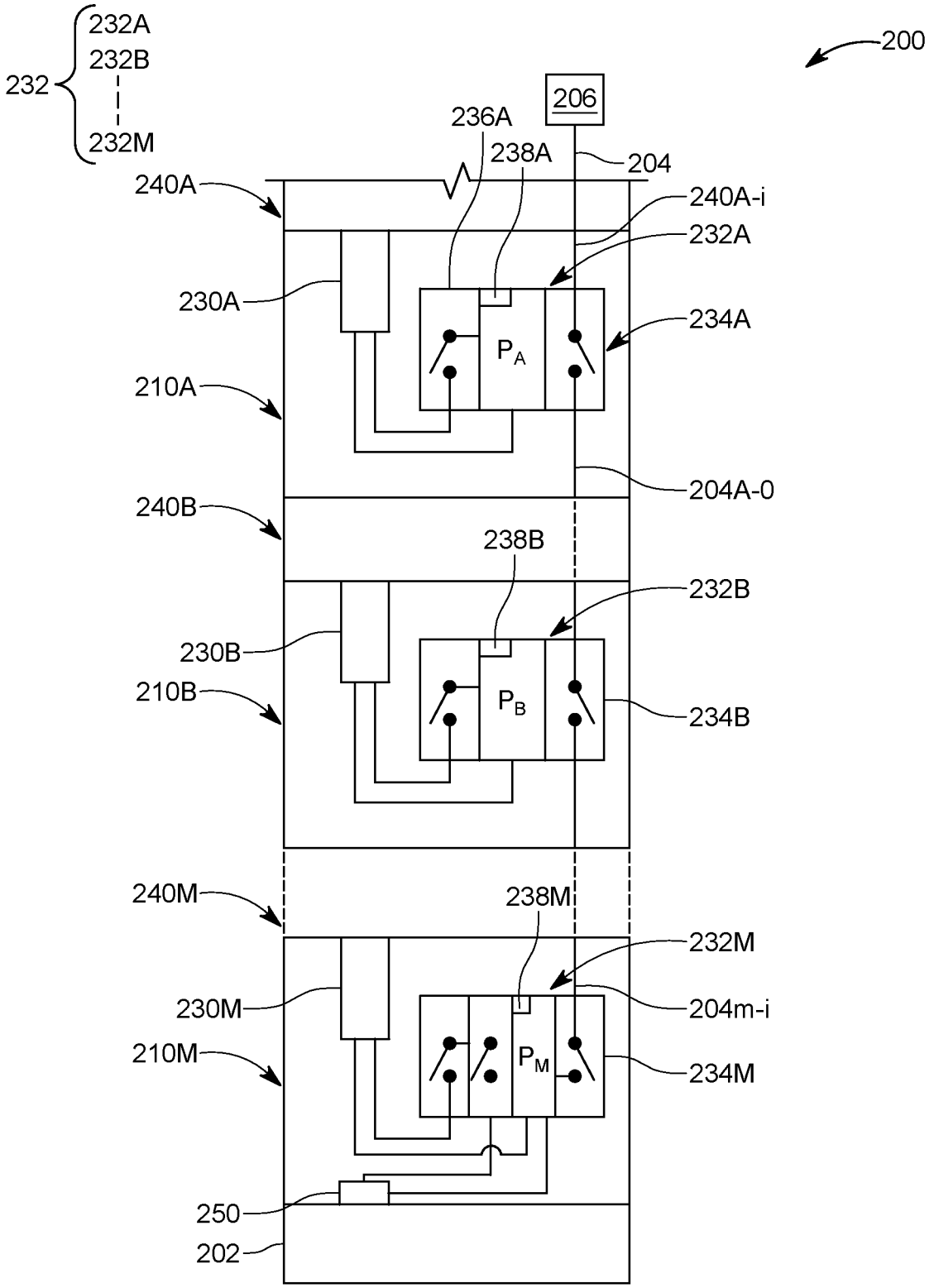
FIG. 2 illustrates a chain of non-addressable switch devices and associated perforating guns.

According to an embodiment illustrated in FIG. 2, which share some but not all components of FIG. 2 of International Patent Application PCT/US2019/036538, which is incorporated herein by reference and is assigned to the assignee of this application, a gun string 200 includes plural perforating guns 240 (shown as elements 240A to 240M, where M can take any numerical value) connected to each other through corresponding subs 210 (numbered 210A to 210M in the figure). In the following, the term "downhole tool" is used to generically refer to a perforating gun or a sub. In one application, no subs are used to connect the perforating guns to each other. If no sub is used, the element 210 can be a detonator module that is attached to a corresponding perforating gun and hosts the switch device. Although FIG. 2 shows element 210 to be physically visible from outside the gun string, in one application it is possible to have either the sub or the detonator sub 210 completely or almost completely located within one or two adjacent perforating guns, so that the element 210 is not visible from outside when the gun string is fully assembled. Note that each perforating gun (except for the most upper perforating gun 240A and the most lower perforating gun 240M) is sandwiched by two subs or two detonator modules, if these elements are present. The upper perforating gun 240A is considered to be the perforating gun first connected to the wireline (not shown in FIG. 2) and the lower perforating gun 240M is considered to be the gun most distal from the wireline, i.e., the perforating gun that is connected to the setting tool 202, if a setting tool is present.

Plural switch devices 232A to 232M, which form a chain 232 of switch devices, and plural detonators 230A to 230M are distributed along the gun string 200. In this embodiment, each sub or detonator assembly 210 includes a corresponding switch device and a detonator, i.e., sub 210A includes switch device 232A and detonator 230A. The same is true for all other subs. In one application, the detonator may be located outside the sub, i.e., inside the perforating gun. The detonator 230A is electrically connected to the switch device 232A and ballistically connected the corresponding perforating gun 240A. The same is true for the other perforating guns, detonators and switch devices.

The switch device 232A (in the following, reference is made to a particular switch device, but it should be understood that this description is valid for any switch device in the chain of switch devices shown in FIG. 2) includes a processor $P_A$ (e.g., application-specific integrated circuit or field-programmable gate array or equivalent semiconductor device) that is electrically connected to two switches. A first switch is the thru-line switch 234A, which may be implemented in software, e.g., firmware, or hardware or a combination of both. The thru-line switch 234A is connected to a thru-line 204, which is electrically connected to the surface controller 206. The thru-line switch 234A is controlled in this embodiment by the processor $P_A$. The thru-line 204 may extend from the surface controller 206 along the wireline (not shown). The portion of the thru-line 204 that enters the switch device 232A is called herein the input thru-line 204A-i and the portion that leaves the switch device 232A is called the output thru-line 204A-o. When the thru-line switch 234A is open, power or other signals sent from the controller 206 down the well cannot pass through the switch device 232A, to the next switch device 232B. By default, all the thru-line switches 234A to 234M are open.

In this embodiment, the surface controller 206 is configured to not send addressable commands or instructions to the various non-addressable switch devices as no switch device is programmed to have or to recognize a digital address. The term "non-addressable switch device" is defined herein to mean a switch device that includes electronics capable of receiving instructions or commands, for example, associated with a current, voltage or frequency pulse, and performing actions corresponding to those instructions or commands, without using a digital address embedded into the current, voltage or frequency pulse. In other words, a non-addressable switch device communicates with the surface controller without using a unique digital address, although the electronics inside the non-addressable switch device technically supports a digital address. This definition does not exclude the scenario in which the surface controller sends instructions having a digital address, but the non-addressable switch device simply ignores the digital address and intercepts and acts upon any instructions coming from the surface controller. For this scenario, only a single non-addressable switch device is on at any time so that only that switch device is capable to intercept that command. All the other switch devices are either on sleep or not yet activated.

The surface controller 206 is configured to apply various voltage or current or frequency patterns (called herein a pulse scheme) to the thru-line 204 for communicating with the non-addressable switch devices. This embodiment shows only a single line (the thru-line 204) extending from the controller 206 to the lower thru-line switch 234M. However, those skilled in the art would understand that more than one wire may extend from the surface controller 206 to the various switch devices. For example, a ground wire may extend in parallel to the thru-line. In this embodiment, the ground wire's role is performed by the casing of the perforating gun.

The switch device 232A also includes a detonator switch 236A, which is also controlled by the processor $P_A$. The detonator switch 236A may be implemented similar to the thru-line switch 234A. The detonator switch 236A is by default open, and thus, no controlling signal can be transmitted from the surface controller 206 or the processor $P_A$ to the corresponding detonator 230A. The switch device 232A may also include a memory 238A (e.g., EPROM memory) for storing various measurements and/or other information. The memory 238A is neither intended nor configured to store a digital address. The lack of the digital address at the switch device is compensated by a bi-directional pulsing scheme used by the surface controller and the switch devices for achieving the desired communication. The pulsing scheme is described later.

Figure 1:
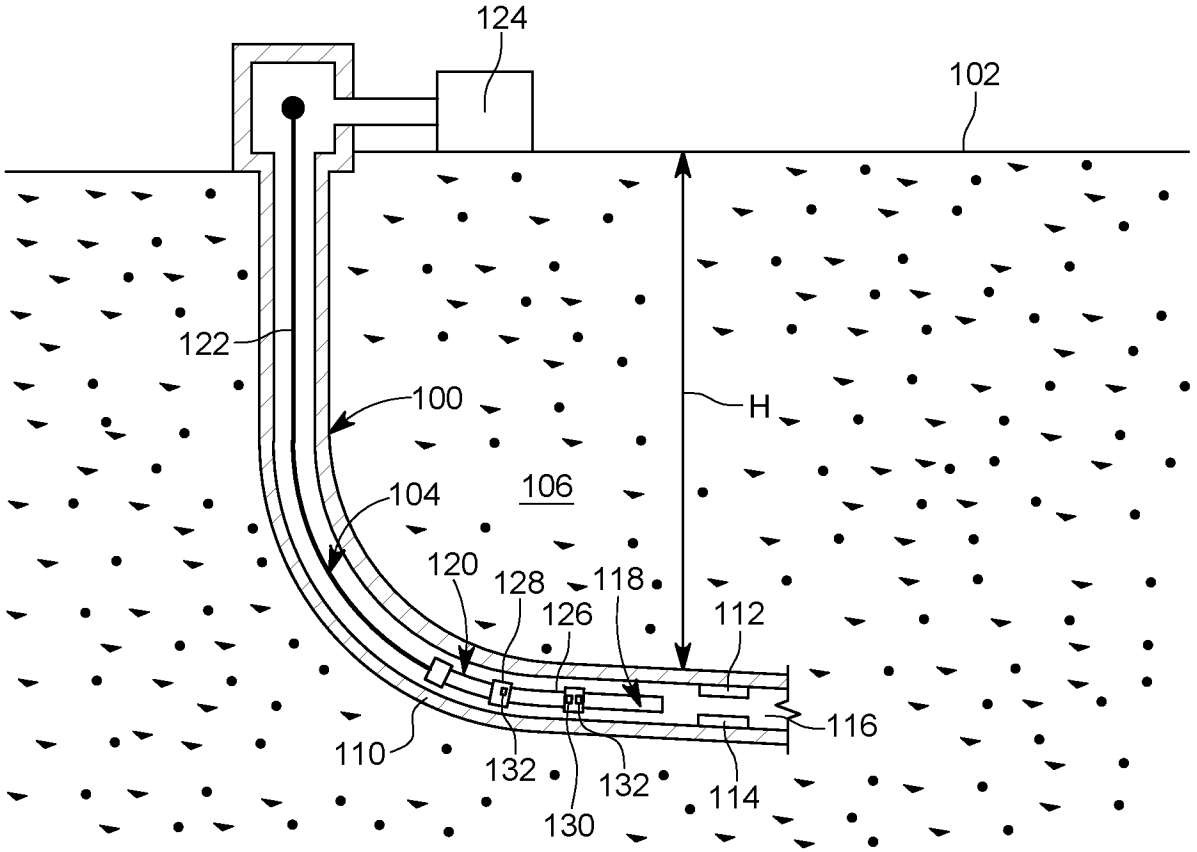
FIG. 1 (BACKGROUND ART)
FIG. 1 illustrates a well and associated equipment for well completion operations.

The lower switch device 234M is different from the other switch devices in the sense that the switch device 234M is also connected, in addition to the input thru-line 204M-i and to the detonator 230M, to a setting tool detonator 250. The setting tool detonator 250 may have the same configuration as the detonator 230M, but it is used to actuate the setting tool 202. The setting tool 202 is used to set the plug 112 (see FIG. 1). Thus, the lower switch device needs to distinguish between two modes: (1) firing the gun detonator 230M or (2) firing the setting tool 202. A method for achieving these results uses unique frequency pulses for these two modes.

Figure 3:
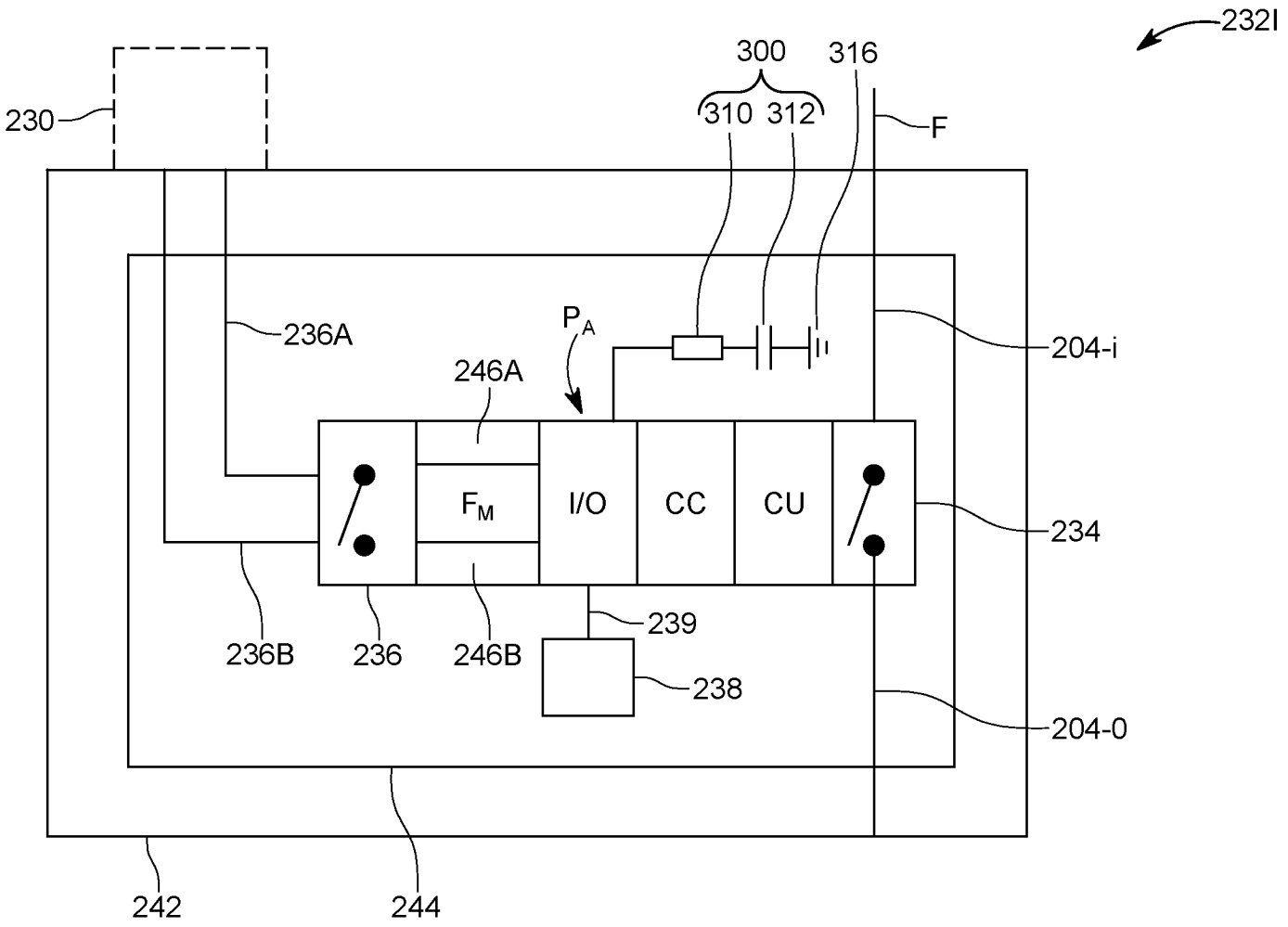
FIG. 3 illustrates a possible configurations of a non-addressable switch device.

A configuration of a non-addressable switch device 232I (which can be any of the switch devices 232A to 232M of the chain 232 discussed with regard to FIG. 2) is illustrated in more detail in FIG. 3. The non-addressable switch device 232I includes the thru-line switch 234 and the detonator switch 236. As discussed above, these two switches may be implemented in hardware (e.g., with semiconductor devices that may include one or more diodes and/or transistors) or in software or both. In this embodiment, it is assumed that the two switches are implemented in software (i.e., in the processor $P_A$). In this case, the two switches 234 and 236 in FIG. 3 are logical blocks that describe the functionality performed by these switches and also their connections to other elements. This means that these logical blocks are physically implemented in the processor $P_A$.

The processor $P_A$ may also include a logical voltage/current/frequency measuring block FM that is configured to measure a frequency of a pulse in the thru-line 204, or more specifically, the input thru-line 204-*i*. In one application, the measuring block FM in an actual measuring unit, separate from the processor $P_A$, but controlled by the processor. Further, the processor may include an interface, for example, a logical or physical block I/O, that can exchange various input and output pulses with the surface controller 206 through the thru-line 204. Logical block I/O may also communicate with the frequency measuring block FM for receiving the measured frequency F and providing this value to the computing core CC of the processor for performing various calculations. Processor $P_A$ is connected to the memory 238 via a bus 239. Computing core CC is capable of storing and/or retrieving various data from the memory 238 and performing various calculations. In one embodiment, memory 238 is a volatile memory, which is a type of memory that erases its data when its power supply is switched off. This type of memory will not retain an address and/or a mode status variable associated with the switch device when no power is supplied, i.e., this memory will not store a digital address. Regarding power, it is noted that in this embodiment the switch device receives its power along the thru-line 204, i.e., there is no local power supply in the switch device or the sub. However, in one application, the switch device may be provided with a power supply.

The processor $P_A$ may further include a communication unit CU that is configured to exchange data with the surface controller 206. As will be discussed later, various unique pulses could be sent by the surface controller 206 to a given switch device. The communication unit CU intercepts those pulses (which are sent along the thru-line 204) and determines, in collaboration with the computing core CC, what information is required by the surface controller 206. The communication unit CU may be configured to use any known communication protocol. The communication unit CU may be implemented in software, as a logical block in the processor $P_A$, as illustrated in FIG. 3. However, the communication unit may also be implemented as dedicated hardware or a combination of hardware and software.

The processor $P_A$ may further include one or more timers. FIG. 3 shows a first timer 246A and a second timer 246B. These timers may be implemented in software, and thus the blocks labeled 246A and 246B in FIG. 3 describe logical blocks associated with these timers. However, in one embodiment, these timers may be implemented as dedicated hardware in combination or not with appropriate software. Although FIG. 3 shows two timers, one skilled in the art would understand from this description that only one timer may be used or more than two timers. The timers are configured to count a given time interval. For example, the first timer 246A may count down from 20 s while the second timer 246B may count down from 1 s. Other values may be used. Once the given time intervals have lapsed, the timers send a message to the processor indicating this fact. As will be discussed later, these timers may be used for implementing safety procedures regarding the firing of a detonator.

FIG. 3 further shows two wires (fire wires) 236A and 236B connecting the detonator switch 236 to the detonator 230. The two wires in FIG. 3 are connected to the detonator 230, which is not part of the switch device 232I. However, one skilled in the art would understand that the detonator may be made part of the switch device. The elements discussed above with regard to the switch device 232I are located inside of a housing 242. The housing can be made of a metal, e.g., aluminum, or a composite material. In one embodiment, the switch device is located inside the detonator block 210, which is configured to also host the detonator. The entire switch device may be distributed on a printed circuit board 244, as schematically illustrated in FIG. 3.

The switch device 232I further includes a resistor-capacitor tank 300 (also called a tank circuit herein) that is electrically connected to the processor $P_A$. The resistor-capacitor tank 300 includes a resistor 310 connected in series with a capacitor 312. One end of the resistor 310 is directly connected to the processor while one end of the capacitor is directly connected to the ground 316. The resistor-capacitor tank 300 prevents the switch device 232I from being counted twice by the surface controller 206, as discussed later.

The structure shown in FIG. 3 can be used for all the switch devices illustrated in FIG. 2, i.e., for the switch devices that are connected to a single detonator, but also for the lower switch device, which is connected to the gun detonator and the detonator of the setting tool. Previously, the setting tool required a separate and unique addressable switch for the actuation of the setting tool detonator. The switch device illustrated in FIG. 3 eliminates the need for the setting tool switch, as the bottom gun non-addressable switch device can apply a shooting voltage to the detonator of the setting tool and afterwards, apply the same or a different shooting voltage to the detonator of the bottom perforating gun.

The switch device 232I may be designed to provide an exact form replacement to the EB style switches currently in use in the industry. The electronic circuit board 244 of the switch device 232I may be potted within the metallic housing 242 by a thermally conductive, electrically isolation epoxy that also provides both electrical and mechanical shock survivability. The construction of the switch device has no moving parts, making it ruggedly built to withstand the blast of the perforating gun and the downhole well pressure.

Each switch device is positioned within a sub connected to a perforating gun to enable the firing of that specific perforating gun while maintaining pressure containment to enable the intrinsically safe arming, and shooting of a single specific perforating gun. A gun string, as discussed above, then consists of multiple pre-assembled and tested perforating guns typically connected, end to end, and lowered to the bottom of the production well. However, as discussed above, if no subs are used in a certain gun string, then the switch devices are positioned in other parts of the gun string.

The gun string is shot starting with the setting tool, which sets a drillable bridge plug. Before the perforation operation begins, the plug seal is hydraulically tested and afterwards the bottom perforating gun in the string is shot, followed by multiple perforating guns being shot at pre-determined points along the course of the well bore. As each perforating gun is shot, the thru-line and electronics associated with the corresponding non-addressable switch device 232I is damaged/disabled by the pressure waves generated by the charges of the perforating gun. Therefore, the non-addressable switch devices cannot be re-used for a second shooting. However, the mechanical housing 242 of the switch device 232I is configured to maintain the pressure integrity of the adjoining perforating gun and the electronic circuitry is reset to prevent voltage being applied to accidentally fire a next perforating gun.

The selection of a given addressable switch device and various operations and/or operating modes associated with the shooting of a perforating gun involve a lengthy procedure, part of which is the reason for the excessive time required for the communications between the external controller and each switch device of the gun string. The procedure for establishing communication with a given addressable switch device and actually actuating a corresponding detonator is known to involve a dozen or more steps. However, with the structure of the non-addressable switch device 232I shown in FIG. 3, this procedure is reduced to a few steps, as now discussed.

Figure 4:
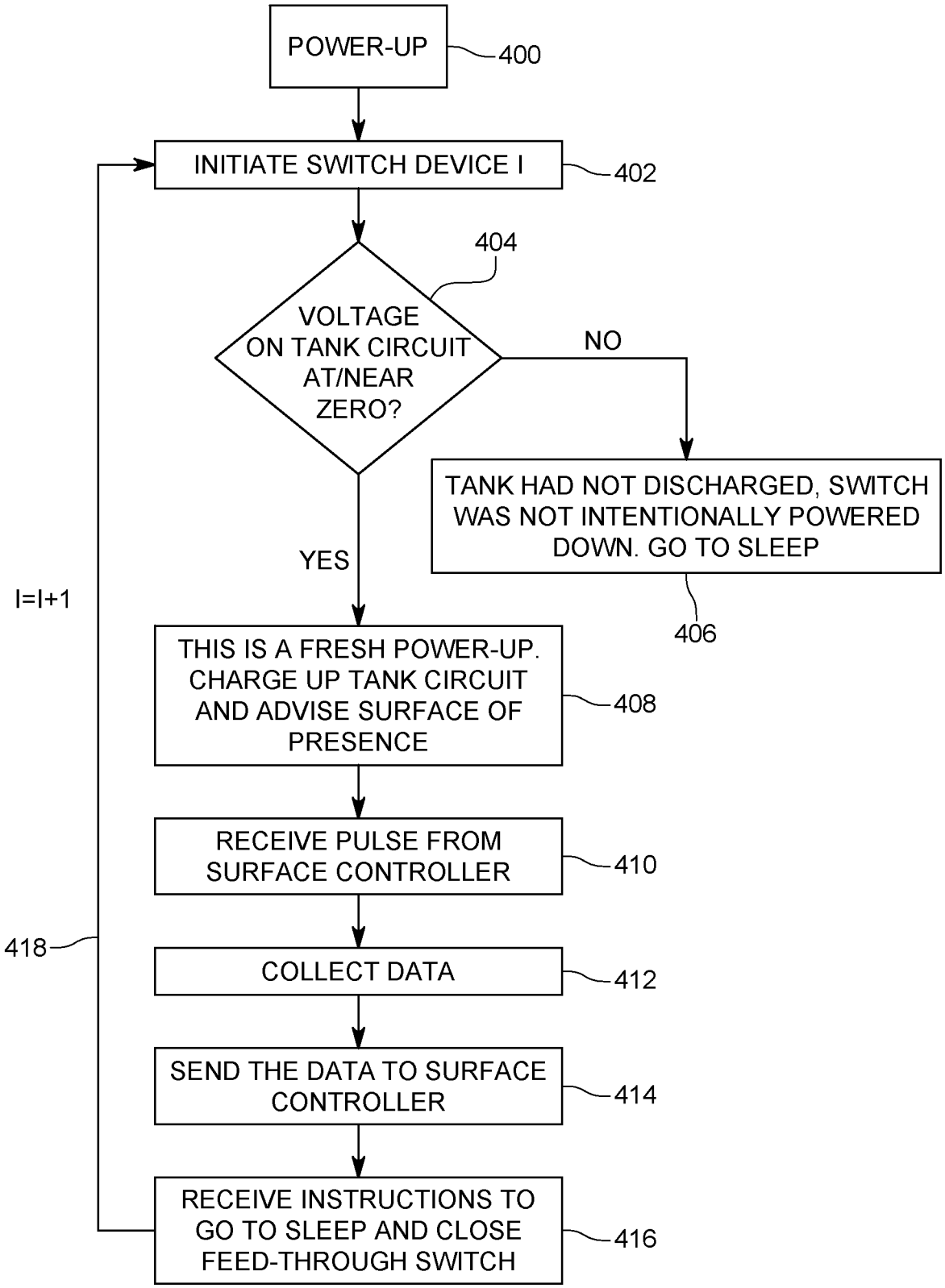
FIG. 4 is a flow chart of a method for controlling with a surface controller the chain of non-addressable switch devices.

FIG. 4 illustrates the pulse scheme used by the surface controller to communicate with the various switch devices 232I of the gun string. In step 400, the surface controller 206 generates a given voltage (usually less than 100 V), which is used in step 402 to power up the first switch device 232A. Note that the feed-through switch 234 is by default open, so that the voltage propagates only to the first switch device 232A of the plural switch devices 232I of the chain 232. An index I is used to describe which switch device is active. For the first switch device, I=1. The processor $P_A$ checks in step 404, after the switch device 232A has been initiated, whether a voltage on the tank circuit 300 is larger than a given threshold or not. Note that a voltage on the tank circuit 300 may be about 5 V when the corresponding switch device is active, and this voltage goes to zero in a matter of several milliseconds. Thus, for example, after the switch device is powered off, the tank circuit 300's voltage is about zero after 1 s. The given threshold may be selected to have any voltage between 0 and 5V.

If the processor $P_A$ determines that the measured voltage on the tank circuit 300 is not below the given threshold (e.g., 2 V), the tank circuit has not been discharged, which means that the switch device has not been intentionally powered down. The processor is programmed to go to sleep in step 406 if this is the situation. The sleep mode is defined herein as being a mode in which the processor on the switch device is instructed to stop receiving pulses from the surface controller and also stop processing any instructions carried by these pulses. The sleep mode is desired because it is needed that the switches consume as little power as possible when there is no communication with them, i.e., after the surface controller sends the bypass command to close the switch 234, so that the surface controller can talk to the next switch in the string 232(I+1). For example, when the switch device enters the sleep mode, the current consumption drops from about 2 mA to about 0.3 mA. Note that when the switch devices are tested, for example, on the surface, after the explosives were connected, a current supply with a limited current can be used to prevent the accidental detonation of the explosives. Thus, the non-active switch devices need to enter the sleep mode to allow the limited current to reach other switch devices.

Figure 5A:
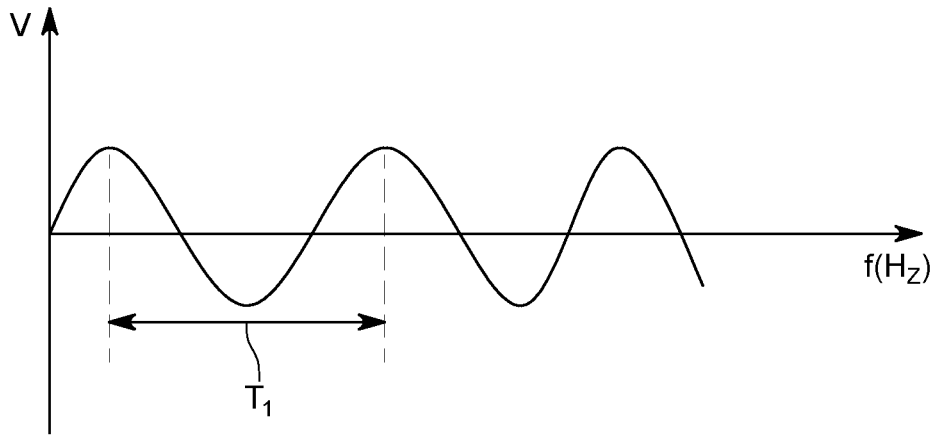
FIGS. 5A and 5B illustrate different pulses that are used to control the non-addressable switch devices.
Figure 5B:
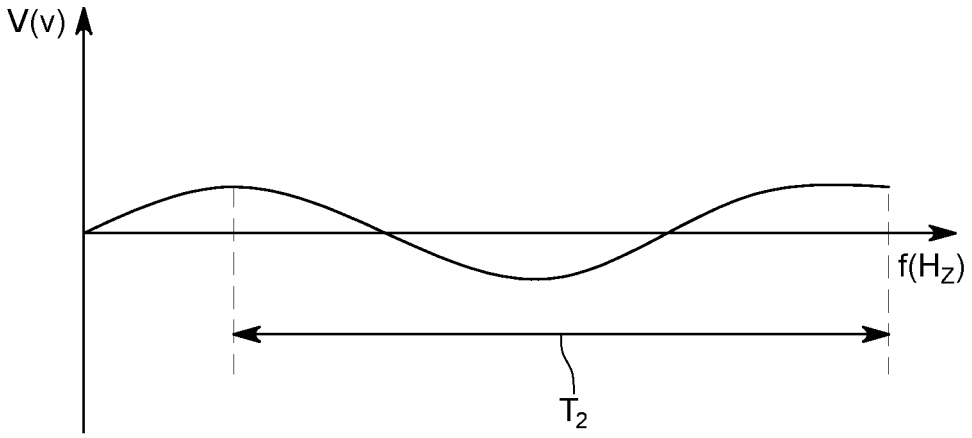

The tank circuit 300 is used in this embodiment to prevent the switch device 232A from being counted twice by the surface controller 206. Note that for an addressable switch, if it bypasses into a short and then immediately wakes up, the addressable switch resends its address to the surface controller. This capability is accomplished by the tank circuit 300 on the switch device 232A. If the switch device is powered off, the tank circuit will self-discharge to 0V over a period of several dozen milliseconds. The tank circuit will be checked by the processor of the switch device at the startup (step 404) to ensure that the tank circuit is empty (sitting at near ground potential). If the tank's voltage is above a minimum threshold, it indicates that the switch has been powered up within the last several milliseconds and so the switch device was not intentionally powered off the last time the switch reset. In this case the switch device will immediately go to sleep in step 406. If the tank circuit is determined to be empty, the processor of the switch device considers this in step 408 to be a new startup, charges the tank circuit up to 5V and reports its presence to surface controller. The step of reporting may be implemented by using one or more unique pulses, i.e., a pulse train having a certain frequency. For example, FIG. 5A shows a first pulse having a first frequency f1, and FIG. 5B shows a second pulse having a second frequency f2, smaller than the first frequency. In one application, the pulses are sent as alternative currents over a direct current. Other implementations are possible. Any number of pulses may be used by the surface controller to communicate with the various switch devices. Each pulse is associated with a specific instruction. For example, the first pulse may be associated with an instruction to check the presence of the detonator, or to check the status of the feed-through switch, or to go to sleep, or to report a short circuit, etc. The second pulse may be associated with another action from the list noted above. Each possible action is associated with a unique pulse.

The surface controller 206 is aware now that a given switch device is on. The surface controller may send a given pulse to the switch device 232A in step 410. The switch device knows (based on the instructions stored in a non-volatile memory associated with its processor) that the given pulse is associated with a specific instruction, for example, to determine the presence of the detonator. For this case, the switch device checks the presence of the detonator in step 412 and then sends the data indicative of this action to the surface controller, in step 414. The data is sent to the surface as another pulse having a unique frequency. The surface controller can then send another pulse for performing another action. This bi-directional pulsing scheme is thus used by the surface controller to request various actions from the switch device and used by the switch device to feed information to the surface controller. Once the surface controller has received all the desired information, it sends another pulse, which is associated with an instruction to go to sleep and activate the feed-through switch 234, in step 416. When receiving this instruction, the switch device 232A closes the switch 234, and goes to sleep. This means that the surface controller 206 can now communicate with the next switch device 232B in step 402, and the previous switch 232A is in a sleep mode.

FIG. 4 shows that the loop 418 can be repeated until each switch device of the switch string is reached. Each time the loop 418 is used, the value I of the current switch device is increased by one. Note that due to this specific implementation of the pulse scheme discussed herein, at any instant, only one switch device 232I of the switch string 232 is awake, while all the other switch devices are either in the sleep mode (those upstream of the switch device), or not yet activated (those downstream from the current switch device). This means that when the surface controller communicates with the last switch device (232M) in the switch chain 232, all the previous (or upstream) switch devices are in the sleep mode. If there is a desire to communicate with a previous switch device 232I, the surface controller is configured to power down the entire switch string 232 and to do a fresh start, i.e., start again with the first switch device 232A, and then go through each switch device in the chain 232 until reaching the desired switch device 232I. Thus, the surface controller can start fresh to communicate, one by one, with each switch device of the switch chain by powering down and restarting the entire switch chain. Note that for this configuration, only a single switch device is active at any instant, and the surface controller can communicate only with the active switch device, and not with the switch devices in the sleep mode or with the switch devices in the non-initiated state. Although the surface controller needs to go through each switch device upstream of the desired switch device for communication, the fact that no digital addresses are exchanged between the surface controller and the switch devices makes this process faster than the existing ones that use digital addresses for each switch device.

To fire a detonator associated with the active switch device, the surface controller sends another pulse, which is different from the other pulses, and which is associated with the fire command. Note that the active mode can be used only by one switch device at any time, as all the other switch devices are either in the sleep mode or in an inactive mode (i.e., not electrically connected to the through line 204). When the current switch device receives the fire pulse, the first timer 246A is started. The first timer 246A may be programmed to count down a first time interval, e.g., a 20 s period. Other time periods may be used. Then the processor checks whether the time period has elapsed. If the answer is yes, the process stops the first timer (and other timers if they have been started) and returns to the active mode.

A second timer 246B may also be started when the fire pulse is received. Starting this second timer is optional. If this second timer is present and started, then it counts down a second time interval, shorter than the first time interval of the first timer. In one application, the second time interval is about 1 s. When the processor determines that the second time interval has lapsed, the processor sends the status of the switch device (e.g., whether the switches are closed or open, whether a voltage has been measured, etc.) back to the surface controller 206. Further, in the same step, the second timer is reset to count down again the second time interval.

The purpose of these two counters is now explained. Assume that a fire pulse has been send from the surface controller 206 to the switch device 232A. To actually fire the detonator associated with this switch device, it is not enough to only send the fire pulse (first condition) because that pulse may be send in error. Thus, a second condition needs to happen in order to actuate the detonator. This second condition is the detection of a parameter (e.g., voltage or frequency) characterizing the thru-line 204 and determining whether a value of this parameter is larger than a given threshold. For example, the threshold voltage can be 140 V. Other values may be used. Note that a voltage in the thru-line during normal operation is much less than the threshold voltage, e.g., about 30 to 60 V. Those skilled in the art would understand that other parameters than voltage may be used, for example, a given frequency.

In this regard, the controller 206 is configured to operate in a low voltage mode when interacting with the switch devices for collecting various data. This is to prevent an accidental firing of the detonator. Thus, in this mode, the controller 206 is configured to generate pulses having an electrical power at a percentage of the minimum fire current needed by the detonators to be fired. In one application, the controller operates at about 10% of the minimum fire current needed to detonate the detonator, i.e., at a reduced current. Other values for this percentage may be used. This makes safe the process of communicating with the current switch device while the gun string is live. Thus, the surface controller 206 communicates, sequentially, with all the switch devices that are able to detect their detonators, while using the reduced current. The surface controller 206 includes, in one embodiment, a display that displays all this information to the operator of the well in real time and records the results of each test in its non-volatile memory for later analysis and download.

Thus, after the fire command was received by the current switch device and the first timer was started, if a voltage increase above the threshold voltage is not detected (second condition for firing) by the current switch device (more precisely, by the measuring unit FM), the process returns to a waiting mode. If the first timer has counted down the first time interval, as a safety measure, because the second condition has not been fulfilled, the process stops the timers and returns to the waiting mode.

However, if a voltage increase above the threshold voltage is detected by the voltage measurement unit of the processor, at the current switch device 232A while the first time interval has not lapsed, then the process advances to fire the detonator 230A. Note that different from all the existing methods in the field, the ultimate/final decision to fire the detonator is made at the switch device level, i.e., by the local processor $P_A$, and not by the surface controller 206. In other words, while the initial decision to fire a perforating gun is made by the operator of the gun string at the surface controller 206, the final decision to actually fire that perforating gun is made locally, at the current switch device 232A. This two-step decision method ensures that the initial decision was not a mistake and also prevents firing in error the detonator.

As a further safety measure (a fail-safe measure), a third timer (or the first timer) is started and is instructed to count down a third time interval. The third time interval may be larger than the first time interval, for example, in the order of minutes. In this specific embodiment, the third time interval is about 4 min. If the detonator was actuated, as previously discussed, the detonation of the charges in the perforating gun would likely destroy the switch device 232A and thus the process stops here for this specific switch device.

However, in the eventuality that the detonator failed to actuate, for any reason, when the processor $P_A$ determines that the third time period has elapsed, it locally decides to turn off the fire process and the process returns to the waiting mode. The processor may also send a status report, as a dedicated pulse, to the surface controller 206, informing that the fire process has failed. Thus, the operator may decide to repeat the firing process or decide to skip the firing of this perforating gun. Irrespective of the decision of the operator, to fire the next perforating gun, the surface controller places the current switch device 232A into the sleep mode, and initiates the next switch device 232B, after which it repeats the steps discussed above.

Figure 6:
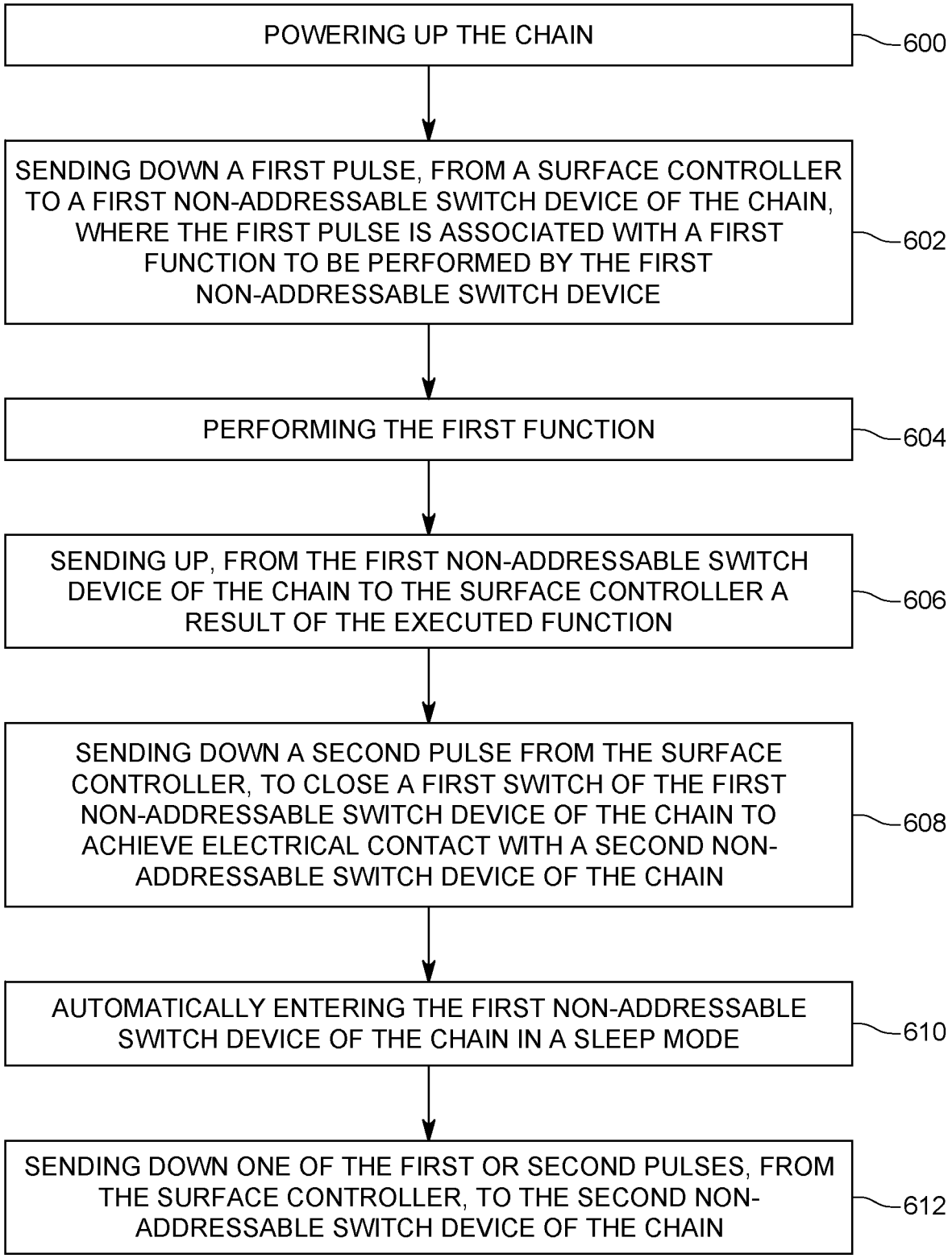
FIG. 6 is a flow chart of a method for communicating with a non-addressable switch device of a chain of non-addressable switch devices.

A method for controlling a chain 232 of non-addressable switch devices 232I associated with a gun string 200 is now discussed with regard to FIG. 6. The method includes a step 600 of powering up the chain, a step 602 of sending down a first pulse, from a surface controller to a first non-addressable switch device of the chain, where the first pulse is associated with a first function to be performed by the first non-addressable switch device, a step 604 of performing the first function, a step 606 of sending up, from the first non-addressable switch device of the chain to the surface controller a result of the executed function, a step 608 of sending down a second pulse from the surface controller, to close a first switch of the first non-addressable switch device of the chain to achieve electrical contact with a second non-addressable switch device of the chain, a step 610 of automatically entering the first non-addressable switch device of the chain in a sleep mode, and a step 612 of sending down one of the first or second pulses, from the surface controller, to the second non-addressable switch device of the chain. It is noted that only one non-addressable switch device of the chain is available for communication with the surface controller.

Based on the above discussed embodiments and methods, the following systems may be implemented in a well. In a first embodiment, a non-addressable switch device 232I, is part of a chain 232 of switch devices 232A to 232M, and the chain is associated with a gun string 200. The non-addressable switch device 232 includes a first switch 234 configured to make an electrical connection between an electrical line 204 and another non-addressable switch device 232(I+1) of the chain of switch devices, a second switch 236 configured to make an electrical connection between a detonator 230 and the electrical line 204, and a processor $P_A$ connected to the first and second switches 234, 236 and configured to close and open the first and second switches 234, 236. The processor $P_A$ is configured to not use a digital address, and the processor $P_A$ is configured to perform one of plural functions based on a corresponding pulse received along the electrical line 204.

In one application, the corresponding pulse is a frequency pulse. The processor is configured to receive plural pulses, each pulse being associated with a different function. The processor is configured to automatically enter a sleep mode when the first switch is closed. The sleep mode prevents the processor to receive instructions and execute functions. The non-addressable switch device may further include a tank circuit 300 configured to store a voltage having a predetermined value, where the processor $P_A$ is configured to measure the predetermined value and determine, based on the measurement, whether the switch device is freshly powered up or the switch device recovered from a short circuit. The tank circuit includes a resistor connected to the processor, and a capacitor connected to the resistor. The processor is configured to send a frequency pulse along the electrical line, to a surface controller, when the switch device is freshly started and to not send a frequency pulse when the switch device recovered from the short circuit.

In another embodiment, there is a non-addressable switch device 232I, that is also part of a chain of switch devices 232A to 232M in a gun string 200. The non-addressable switch device 232 includes a first switch 234 configured to make an electrical connection between an electrical line 204 and another non-addressable switch device 232(I+1) of the chain of switch devices, a second switch 236 configured to make an electrical connection between a detonator 230 and the electrical line 204, a processor $P_A$ connected to the first and second switches 234, 236 and configured to close and open the first and second switches 234, 236, and a tank circuit 300 configured to store a voltage having a predetermined value. The processor $P_A$ is configured to measure the predetermined value and determine, based on the measurement, whether the switch device is freshly powered up or the switch device recovered from a short circuit.

The processor $P_A$ is configured to not use a digital address, and the processor $P_A$ is configured to perform one of plural functions based on a corresponding pulse received along the electrical line. In one application, the tank circuit includes a resistor connected to the processor, and a capacitor connected to the resistor. In this or another application, the processor is configured to send a frequency pulse along the electrical line, to a surface controller, when the switch device is freshly started and to not send a frequency pulse when the switch device recovered from the short circuit. The corresponding pulse may be a frequency pulse. The processor may be configured to receive plural pulses, each pulse being associated with a different function, and each pulse being devoid of a digital address. The processor is configured to automatically enter a sleep mode when the first switch is closed. The sleep mode prevents the processor to receive instructions and execute functions.

In yet another embodiment, a chain of non-addressable switch devices 232I includes plural non-addressable switch devices 232I electrically connected to each other through an electrical line 204, and plural downhole tools 240, each hosting a corresponding non-addressable switch device 232I. Each non-addressable switch device 232I includes a first switch 234 configured to make an electrical connection between the electrical line 204 and another non-addressable switch device 232(I+1) of the chain of switch devices, a second switch 236 configured to make an electrical connection between a corresponding detonator 230 and the electrical line 204, and a processor $P_A$ connected to the first and second switches 234, 236 and configured to close and open the first and second switches 234, 236. The processor $P_A$ is configured to not use a digital address, and the processor $P_A$ is configured to perform one of plural functions based on a corresponding pulse received along the electrical line.

Only one non-addressable switch device of the chain is awake, and all remaining non-addressable switch device are either in a sleep mode or not yet connected to the electrical line. In one application, each non-addressable switch device further includes a tank circuit 300 configured to store a voltage having a predetermined value, where the processor $P_A$ is configured to measure the predetermined value and determine, based on the measurement, whether the switch device is freshly powered up or the switch device recovered from a short circuit.

The disclosed embodiments provide methods and systems for communicating between a surface controller and a single switch device that belongs to a switch string without using a digital address. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A non-addressable switch device that is part of a chain of switch devices in a gun string, the non-addressable switch device comprising:

a first switch configured to make an electrical connection between an electrical line and another non-addressable switch device of the chain of switch devices;

a second switch configured to make an electrical connection between a detonator and the electrical line; and a processor Pa connected to the first and second switches and configured to close and open the first and second switches, wherein the processor Pa is configured to not use a digital address, and wherein the processor Pa is configured to perform one of plural functions based on a corresponding pulse received along the electrical line.

2. The non-addressable switch device of claim 1, wherein the corresponding pulse is a frequency pulse having a unique frequency.

3. The non-addressable switch device of claim 1, wherein the processor Pa is configured to receive plural pulses, each pulse of the plural pulses being associated with a different function and a unique frequency.

4. The non-addressable switch device of claim 1, wherein the processor Pa is configured to automatically enter a sleep mode when the first switch is closed.

5. The non-addressable switch device of claim 4, wherein the sleep mode prevents the processor Pa to receive instructions and execute the plural functions.

6. The non-addressable switch device of claim 1, further comprising:

a tank circuit configured to store a voltage having a predetermined value, wherein the processor Pa is configured to measure the predetermined value and determine, based on the measurement of the predetermined value, whether the non-addressable switch device is freshly powered up or the non-addressable switch device recovered from a short circuit.

7. The non-addressable switch device of claim 6, wherein the tank circuit includes a resistor connected to the processor Pa, and a capacitor connected between the resistor and ground.

8. The non-addressable switch device of claim 6, wherein the processor Pa is configured to send a frequency pulse along the electrical line, to a surface controller, when the non-addressable switch device is freshly started and to not send the frequency pulse when the non-addressable switch device recovered from the short circuit.

9. A chain of a plural of non-addressable switch devices comprising:

the plural of the non-addressable switch devices electrically connected to each other through an electrical line; and plural downhole tools, each downhole tool of the plural downhole tools hosting a corresponding non-addressable switch device of the plural of the non-addressable switch devices, wherein each non-addressable switch device of the plural of the non-addressable switch devices includes, a first switch configured to make an electrical connection between the electrical line and another non-addressable switch device of the chain of the plural of the non-addressable switch devices;

a second switch configured to make an electrical connection between a corresponding detonator and the electrical line; and a processor Pa connected to the first and second switches and configured to close and open the first and second switches, wherein the processor Pa is configured to not use a digital address, and wherein the processor Pa is configured to perform one of plural functions based on a corresponding pulse received along the electrical line.

10. The chain of the plural of the non-addressable switch devices of claim 9, wherein only one non-addressable switch device of the chain of the plural of the non-addressable switch devices is awake, and each non-addressable switch device of remaining of the plural of the non-addressable switch devices are either in a sleep mode or not yet connected to the electrical line.

11. The chain of the plural of the non-addressable switch devices of claim 9, wherein said each non-addressable switch device of the plural of the non-addressable switch devices further includes:

a tank circuit configured to store a voltage having a predetermined value, wherein the processor Pa is configured to measure the predetermined value and determine, based on the measurement of the predetermined value, whether said each non-addressable switch device is freshly powered up or said each non-addressable switch device recovered from a short circuit.

* * * * *